US008933310B2

(12) United States Patent
Rogers

(10) Patent No.: US 8,933,310 B2
(45) Date of Patent: Jan. 13, 2015

(54) ACOUSTIC/ELECTRONIC DRUM ASSEMBLY

(75) Inventor: Thomas P. Rogers, Edgewater, NJ (US)

(73) Assignee: RTOM Corporation, Carlstadt, NJ (US)

( * ) Notice: Subject to any disclaimer, the term of this patent is extended or adjusted under 35 U.S.C. 154(b) by 119 days.

(21) Appl. No.: 13/292,115

(22) Filed: Nov. 9, 2011

(65) Prior Publication Data

US 2013/0112068 A1 May 9, 2013

(51) Int. Cl.
*G10F 1/08* (2006.01)
*G10D 13/02* (2006.01)
*G10H 3/00* (2006.01)

(52) U.S. Cl.
CPC ..... *G10D 13/02* (2013.01); *G10H 3/00* (2013.01); *G10D 13/022* (2013.01); *G10D 13/027* (2013.01)
USPC ..... 84/104; 84/411 R; 84/723; 84/735

(58) Field of Classification Search
None
See application file for complete search history.

(56) References Cited

U.S. PATENT DOCUMENTS

| | | | |
|---|---|---|---|
| 635,192 | A | 10/1899 | Sapp |
| 729,936 | A | 6/1903 | Heybeck |
| 1,072,687 | A | 9/1913 | Beauregard |
| 1,579,893 | A | 4/1926 | Simpson |
| 1,634,151 | A | 6/1927 | Lannon et al. |
| 1,789,992 | A | 1/1931 | Stevens |
| 2,485,985 | A | 10/1949 | Perry |
| 2,564,933 | A | 8/1951 | Sommerville |
| 3,105,406 | A | 10/1963 | Ippolito |
| 3,283,909 | A | 11/1966 | Daubman |
| 3,453,924 | A | 7/1969 | Glick et al. |
| 3,596,385 | A | 8/1971 | Tachibana |
| 3,635,119 | A | 1/1972 | Thompson |
| 3,867,863 | A | 2/1975 | Vennola et al. |
| 4,102,235 | A | 7/1978 | Le Masters |
| 4,244,266 | A | 1/1981 | Hardy |
| 4,278,003 | A | 7/1981 | Hanson |
| 4,325,280 | A | 4/1982 | Hardy |
| 4,520,709 | A | 6/1985 | Kester, Jr. |
| 4,549,462 | A | 10/1985 | Hartry et al. |

(Continued)

FOREIGN PATENT DOCUMENTS

| | | | |
|---|---|---|---|
| CN | 201868088 | U | 6/2011 |
| JP | 11184559 | A | 7/1999 |

(Continued)

OTHER PUBLICATIONS

Rule, Greg and Fisher, Steve, "How Roland Became the Biggest Drum Company in the World," V-Drums with Mesh Drum Heads. See patent 5,920,026 by Yoshiro, 1997, (Roland Mesh Head) http://www.rolandus.com/community/insider/hands_on_articles.aspx?ArticledId=21, viewed Jul. 22, 2008.

(Continued)

*Primary Examiner* — Marlon Fletcher
(74) *Attorney, Agent, or Firm* — Florek & Endres PLLC

(57) ABSTRACT

An acoustic/electronic drum assembly comprising a mesh batter drumhead comprising a mesh membrane and an annular ring, a resonant drumhead comprising an acoustic membrane and an annular ring, the acoustic membrane capable of creating acoustic sound in response to a force applied to the mesh batter drumhead, an annular shell member for maintaining the mesh batter drumhead in fixed relation to the resonant drumhead, and a pick-up acoustically coupled to at least the resonant drumhead for picking up the acoustic sound and creating an electrical signal.

23 Claims, 2 Drawing Sheets

(56) References Cited

U.S. PATENT DOCUMENTS

| | | | | |
|---|---|---|---|---|
| 4,589,323 | A | 5/1986 | Belli et al. | |
| 4,726,130 | A | 2/1988 | Bussard | |
| 4,745,839 | A | 5/1988 | Peraino | |
| 4,770,918 | A | 9/1988 | Hayashi | |
| 4,828,907 | A | 5/1989 | Hayashi | |
| 4,870,883 | A | 10/1989 | Gauger | |
| 4,927,290 | A | 5/1990 | Bowman | |
| 4,976,719 | A | 12/1990 | Siepser | |
| 5,025,697 | A | 6/1991 | May | |
| 5,042,356 | A | 8/1991 | Karch | |
| 5,151,150 | A | 9/1992 | Davis et al. | |
| 5,316,407 | A | 5/1994 | Miller | |
| 5,392,681 | A | 2/1995 | Hall | |
| 5,404,784 | A | 4/1995 | Steenbock | |
| 5,492,047 | A | 2/1996 | Oliveri | |
| 5,493,942 | A | 2/1996 | Wolf | |
| 5,561,254 | A | 10/1996 | Huffer | |
| 5,708,045 | A | 1/1998 | Thompson et al. | |
| 5,811,709 | A * | 9/1998 | Adinolfi | 84/723 |
| 5,892,169 | A | 4/1999 | Shapiro | |
| 5,920,026 | A | 7/1999 | Yoshino et al. | |
| 5,962,798 | A | 10/1999 | Meinl | |
| 5,998,716 | A | 12/1999 | Marquez et al. | |
| 6,043,419 | A | 3/2000 | Arbiter | |
| 6,060,651 | A | 5/2000 | Basmadjian | |
| 6,069,307 | A | 5/2000 | Rogers | |
| 6,121,528 | A * | 9/2000 | May | 84/411 R |
| 6,150,594 | A | 11/2000 | Fiondella et al. | |
| 6,291,754 | B1 | 9/2001 | Gatzen et al. | |
| 6,518,490 | B2 | 2/2003 | Good | |
| 6,525,249 | B1 * | 2/2003 | Suenaga | 84/411 R |
| 6,586,665 | B1 | 7/2003 | Liao et al. | |
| 6,784,352 | B2 * | 8/2004 | Suenaga | 84/411 R |
| 6,921,857 | B2 | 7/2005 | Yoshino et al. | |
| 6,982,376 | B2 * | 1/2006 | Wise | 84/600 |
| 7,135,630 | B2 | 11/2006 | Maruhashi et al. | |
| 7,179,985 | B2 * | 2/2007 | Pickens | 84/743 |
| 7,259,317 | B2 * | 8/2007 | Hsien | 84/723 |
| 7,514,617 | B2 | 4/2009 | Rogers et al. | |
| 7,525,032 | B2 * | 4/2009 | Mishima | 84/477 R |
| 7,781,661 | B2 | 8/2010 | Rogers et al. | |
| 2003/0136245 | A1 | 7/2003 | Okumura | |
| 2005/0022655 | A1 * | 2/2005 | Wise | 84/743 |
| 2006/0021495 | A1 * | 2/2006 | Freitas | 84/723 |
| 2006/0065099 | A1 | 3/2006 | Anderson | |
| 2006/0219092 | A1 * | 10/2006 | Mishima | 84/724 |
| 2006/0230912 | A1 * | 10/2006 | Pickens | 84/743 |
| 2006/0272490 | A1 * | 12/2006 | May | 84/743 |
| 2007/0022863 | A1 | 2/2007 | Ross | |
| 2007/0051231 | A1 * | 3/2007 | Fujii | 84/723 |
| 2007/0137459 | A1 * | 6/2007 | Hsien | 84/421 |
| 2007/0163422 | A1 * | 7/2007 | Rogers et al. | 84/411 R |
| 2007/0163423 | A1 * | 7/2007 | Rogers | 84/411 R |
| 2007/0169610 | A1 * | 7/2007 | Pickens | 84/411 R |
| 2007/0234886 | A1 | 10/2007 | Matsuyuki et al. | |
| 2008/0121088 | A1 * | 5/2008 | Curet Troche | 84/413 |
| 2009/0000464 | A1 * | 1/2009 | Mishima | 84/724 |
| 2009/0249939 | A1 * | 10/2009 | Rogers et al. | 84/413 |
| 2011/0259175 | A1 * | 10/2011 | Mollick | 84/421 |

FOREIGN PATENT DOCUMENTS

| | | | |
|---|---|---|---|
| JP | 2010072510 | A | 4/2010 |
| SU | 00217196 | A | 7/1968 |
| WO | 2005017874 | A2 | 2/2005 |

OTHER PUBLICATIONS

Pearl, Muffle Drum Heads, http://www.steveweissmusic.com/product/30359/mesh-drum-heads, viewed Jul. 22, 2008.

BUXjr Electronic Studio Drum Kit 2002, featuring mesh drum heads by Pearl, http://www.buxjr.com/wwwdrums/, viewed Jul. 22, 2008.

Roland Mesh Head Replacements, http://www.musiciansfriend.com/drums-percussion/roland-mh-12-mesh-v-replacement-head-12, , viewed Jul. 22, 2008.

Young, Lee W., International Preliminary Report on Patentability with Written Opinion of the International Searching Authority, International Bureau of WIPO, Apr. 23, 2008, for International Application No. PCT/US2007/001533.

Khaborova, N., "International Search Report and Written Opinion of the International Searching Authority, or the Declaration (for International Patent Application No. PCT/US2012/064043)," Feb. 21, 2013.

* cited by examiner

ACOUSTIC/ELECTRONIC DRUM ASSEMBLY

FIELD OF THE INVENTION

The present invention relates to the field of musical drums and more particularly to the field of musical drums having electronics for pick-up, processing, amplification and user adjustment of acoustic sound and tonal characteristics.

BACKGROUND OF THE INVENTION

Conventional acoustic drums are generally comprised of a solid shell and one or two tunable membranes locked into an annular frame, generally referred to as a drumhead, which is tensioned over the shell.

To provide the proper tension to the drumhead, the shell has an arrangement of tensioning lugs attached to it, with threaded tension rods extending from the tensioning lugs. During installation, the drumhead with an annular frame is placed over the shell and a counter hoop, or rim, is placed over the annular frame. The tension rods engage the counter hoop and the tensioning lugs are tightened to stretch the drumhead membrane. By adjusting the torque of the tension rods within the tensioning lugs, the stretched drumhead membrane changes pitch.

More particularly, the tensioning lug, tension rod and counter hoop arrangement is a system that is designed to apply a stretching force to a drumhead, typically in a uniform manner, to stretch the drumhead membrane over the shell. By tightening the tensioning lugs, the tension rods pull on the counter hoop to tension the drumhead membrane thereby increasing the pitch when a striking force is applied to the drumhead membrane, i.e., by striking the drumhead membrane with a drumstick. Conversely, loosening the tensioning lugs permits the tension rods to release tension on the counter hoop thereby lowering the pitch of the drumhead membrane when a striking force is applied.

As such, the stretching of the drumhead membrane to the desired tension is what gives the drum its musical and playing characteristics when a striking force is applied, including pitch, stick rebound, etc. The tone of the drum and the stick rebound, usually referred to as the "feel" of the drum, are determined by such variables as the drumhead diameter, its tension and the thickness of the drumhead membrane.

More recently, electronic drum sets have become popular to create drum sounds without the typical size and acoustic volume of conventional musical drums. The electronic drums are generally formed of pads with sensors, to generate an electrical signal when a striking force is applied to the drum pad or head. The sensors are typically piezo sensors that output voltage to a computer module (typically referred to as a drum brain) that has stored sampled sounds. The processed signal is then amplified and sent to speakers, headphones or the like, allowing the drummer and/or listeners to hear the sounds generated during drumming. More sophisticated electronic drum sets include additional or more complex sensors that distinguish between differences in the amount of force used to strike the pad and the location of the force on the pad, in an effort to simulate the sounds generated by a conventional drum that differentiates between those and other factors.

The electronic drums permit a drummer to play in practice environments without the volumes associated with playing conventional drums, generating external volumes no louder than striking the pads, while listening to the sampled sounds through headphones. Additionally, it permits the signal to be amplified and sent to speakers for use in performance environments.

However, the range of sampled sounds provided by the computer module, and the processing of those sounds, are limited in the range of different sounds and tones. Moreover, the sounds created are manipulated to replicate the sounds of conventional acoustic drums, but lack the dynamic range and variations associated with acoustic drums. It is therefore an object of the invention to provide an acoustic/electronic drum assembly that produces lower volume acoustic signals that can be electronically picked up, processed and amplified. Moreover, this object of the invention would permit the user to adjust the sound and tonal characteristics of the electrical signals.

It is another object of the present invention to provide an acoustic/electronic drum assembly that maintains the feel of a conventional acoustic drum and preserve much of the sound and tonal characteristics, including the range of different sounds and tones, of a conventional acoustic drum. This includes maintaining the dynamic range of an acoustic drum, heretofore unavailable in an electronic drum.

SUMMARY OF THE INVENTION

These and other objects are achieved by the present invention, which is directed to an acoustic/electronic drum assembly comprising a batter drumhead comprising a mesh membrane and an annular ring, a resonant drumhead comprising an acoustic membrane and an annular ring, the acoustic membrane being capable of creating acoustic sound waves in response to a striking force applied to the batter drumhead, an annular shell member for maintaining the batter drumhead in fixed relation to the resonant drumhead, and a pickup acoustically coupled to at least the resonant drumhead for picking up the acoustic sound waves and creating an electrical signal.

Most preferably, the batter drumhead is a single ply, or one layer, mesh membrane or material formed in much the same manner as a standard solid or acoustic membrane resonant drumhead. More particularly, the peripheral edge of the mesh membrane is mechanically clamped in an annular ring, using a variety of methods know to those skilled in the art.

As used herein, a "mesh" membrane of the batter drumhead refers to a permeable membrane, having an open weave with openings through which air can pass, formed as a woven material, a perforated material or the like. The mesh membrane is the antithesis of a solid, substantially solid, acoustic or resonant membrane (the terms used interchangeably and inclusively herein), as used in acoustic drumheads, and sound energy or volume of the output from a mesh membrane can be far less than the sound energy generated by an acoustic membrane. This reduced output from the mesh membrane provides a quiet playing surface and allows the drummer to experience playing on a tensioned surface, virtually the same as that of an acoustic drumhead, with greatly reduced sound energy output.

Although the tensioned mesh batter head provides a quiet playing surface, it generates a significant amount of tone and stick attack (i.e., a stick's acoustic signature by way of the size of the material, etc., and tone generated by the stick substrate coming into contact with the head). When the tensioned mesh membrane is retained in relatively close proximity to a tensioned acoustic membrane, which is generally solid, the vibrations of the mesh membrane cause a sympathetic vibration response from the acoustic membrane. When the mesh membrane and the acoustic membrane are similarly tensioned, sympathetic vibration of the acoustic membrane from the mesh membrane creates a low volume sound response with substantially the same pitch and tone as that of when a striking force is applied directly to the acoustic membrane.

An analogy would be bringing a vibrating tuning fork close to a non-vibrating tuning fork of the same predetermined pitch. As the vibrating tuning fork A is moved closer to the non-vibrating tuning fork B, the vibrating tuning fork A will cause the non-vibrating fork to begin to sympathetically vibrate. As tuning fork A moves closer to tuning fork B, the output from tuning fork B will increase. In other words, the open air between tuning fork A and tuning fork B makes for a poor medium, but as the tuning forks are brought closer together the air gap is overcome by the energy level of tuning fork A.

The open percentage of the mesh membrane is one variable that affects the characteristics of the present acoustic/electronic drum assembly. The more open area, the less air will be moved when the mesh membrane of the batter drumhead is struck, affecting both the amount of sound energy generated by the batter drumhead as well as the "coupling" with the acoustic membrane on a resonant drumhead.

The "coupling" is the response of the acoustic membrane of the resonant drumhead to a striking force applied to the mesh membrane of the batter drumhead. Factors affecting the level of coupling include such factors as the open area of the mesh membrane, the tuning of the batter drumhead, the frequency of the vibration, the tuning of the resonant drumhead and the distance between the mesh membrane of the batter drumhead and the acoustic membrane of the resonant drumhead. For example, to maximum the amount of coupling when using a high percentage open area mesh membrane, the resonance of mesh and acoustic membranes should be as close as possible.

On the other hand, if the mesh membrane has a high percentage open area, i.e., a higher ratio of open to closed area, and it is tuned significantly out of pitch with the acoustic membrane, one would see poor coupling and virtually no output from the acoustic membrane. Returning to the tuning fork analogy, if the vibrating tuning fork A is substantially different in pitch than tuning fork B, there would be little sympathetic vibration no matter how close vibrating tuning fork A is placed to non-vibrating tuning fork B. Therefore, the batter drumhead must not only be sufficiently close, but must also be properly tuned to the resonant drumhead to provide an appropriate low volume replication of sound from the resonant drumhead.

In its preferred embodiment, the batter drumhead is tensioned over an annular shell member, where the annular ring of the batter drumhead, in which the mesh membrane is preferably fixed, is engaged to apply the proper tension to the mesh membrane. The annular shell member is preferably formed as a conventional drum shell, preferably being solid and made of any suitable material including but not limited to wood, metals such as steel, brass, aluminum, etc., polymeric materials including plastics and resins or resin impregnated materials such as carbon fibers, wood chips or dust, etc.

Tensioning of the batter drumhead on the annular shell member is preferably achieved with the use of conventional drum tuning hardware, including tension rods, tensioning lugs and a counter hoop. In the most preferred embodiment, the annular shell member is a drum shell having threaded tensioning lugs attached thereto, which cooperate with tension rods passing through a counter hoop placed over the annular ring of the drumhead. Although any suitable arrangement of tension rods and tensioning lugs can be used, it is typical to use 6-12 tension rod assemblies, depending on the drum diameter, spaced evenly about the circumference of the drum shell.

Of course, one or both of the batter and resonant drumheads can be tensioned by any known device, including the use of an annular tensioning ring which creates an even tension across the membrane of the drumhead. Such a device is described in U.S. Pat. Nos. 7,498,500, 7,514,617 and 7,781,661, providing a tensioning ring that can be placed inside of the drumhead membrane to tension the membrane from the inside outward. The preferred tensioning ring comprises an expansion mechanism, such as a turnbuckle, that can be operated to expand the diameter of the tensioning ring to tune the membrane of the drumhead, or may be a fixed spacer, that merely maintains the tensioning ring in a pre-tensioned configuration without adjustment.

However, in the most preferred embodiment of the present invention, the resonant drumhead is preferably placed on or within the annular shell member on which the batter drumhead is mounted. In the embodiment where the annular shell member is a drum shell, this is preferably done by providing opposed tensioning lugs, formed either independently or opposite sides of the tensioning lugs used to tension the batter drumhead. As such, in the most preferred embodiment, the resonant drumhead is tensioned over the opposite side of the drum shell from the batter drumhead.

The distance between the mesh membrane and the acoustic membrane can therefore be fixed based upon the height of the annular shell member to dictate the tonal frequency and quality of the overall drum. When the batter drumhead and resonant drumhead are tensioned over opposed top and bottom edges of a drum shell, the height of the shell defines the distance between the mesh and acoustic membranes.

When using a single batter drumhead and a single resonant drumhead, the distance between the mesh membrane and the acoustic membrane should be between 0.5 and 6 inches, preferably between 0.5 and 4 inches and most preferably between 0.5 and 2 inches. In this regard, a distance of less than 2 inches is most preferred to maximize coupling of the mesh and resonant heads and a distance of over 6 inches is considered to be so great that the transfer of energy (through air movement generated by striking the mesh batter drumhead) is not significant enough to produce a desired output from the resonant head.

The pick-ups can be any suitable type, but one or more microphones placed within the annular shell member or drum shell is a preferred method of picking up the analog sound waves generated by the resonant drumhead, as well as any desired sound waves generated by the mesh batter drumhead. These can include the use of microphones with polar patterns varying from omni-directional to hyper-cardioid and microphone designs ranging from dynamic to electret, etc.

A support structure, such as a beam extending from the interior of the annular shell member, is preferably used to mount the one or more microphones between the mesh batter head and the resonant head. The pick-up or microphone should be spaced at least ⅜ of an inch from the underside surface of the batter head so that it is not physically contacted when the mesh batter head is struck with a drumstick. Although placement of the pick-up off axis of the drumhead center will provide suitable results, it is optimal for the pick-up to be placed as close as possible to the center of the drumhead circumference.

With respect to the pick-up, two microphones may be employed, and may be wired either in phase or out of phase. Depending on the manufacturing design of the microphones, a pair may perform better in their individual response curves with the phase in or out. For example, DPA Microphones are designed in such a way that the phase of the microphones does not matter. Other manufacturers have different acoustic housings that require attention to phase. In either case the elimination of acoustic signal cancellation and maximum signal pick-up from the respective batter and resonant heads is the goal.

The pick-ups preferably convert the analog sound waves to electrical signals that can be processed using any suitable signal processing device for processing analog or digital signals, i.e., for making a change to the original wave form, including but not limited to amplifiers used to power headphones or speakers, equalizers, reverb, digital signal processors (DSP) for processing, where any number of signal modifications may take place prior to amplification, etc. Of the many possible modifications, the DSP is preferred if the intent is to permit adjustments to equalization, reverb and any other sound or tonal characteristics to create and enhance the acoustic signature generated by the resonant and/or batter drumheads.

The goal through research, analytical analysis and listening comparisons is preferably to be able to mimic the sound of a standard acoustic drum relative to the drum being emulated. For example, a 16 inch floor tom may be reproduced by a similar sized electro-acoustic drum with mesh batter and resonant drumheads and associative DSP processing. A further goal of the invention to make an electro-acoustic drum which generates its own significant acoustic signature that may then be modified by DSP circuitry to provide the user with a number of variations on the original sound of the drum.

Although it is intended that the analog sound waves generated by the resonant head are being picked-up for conversion to electrical signals, to create an acoustic coupling of the resonant drumhead with the pick-ups, some analog sound waves may be picked up from the mesh batter drumhead as well. Placement of the pick-ups may increase or minimize the sound waves from the mesh batter drumhead, where placement between the mesh batter and resonant drumheads increases the sound waves picked up from the mesh batter drumhead and placement on the side of the resonant drumhead opposite the batter drumhead would tend to pick up the sound waves generated by the resonant drumhead almost exclusively.

The pick-ups can be mounted in any suitable fashion, and preferably off of any solid structure including the drum shell itself, or any other suitable member found in the assembly. Most preferably, a pick-up support structure extends from the interior of the drum shell to the center of the drum shell to maintain the pick-up in the center of the drumhead circumference.

In an alternative embodiment, the drum may include a second resonant drumhead between the mesh batter head and the lower resonant head. In the preferred alternative embodiment, an annular shell member in the form of a drum shell spacer is used in connection with the drum shell to permit the addition of a second resonant head. The second resonant head, preferably located intermediate the mesh batter head and the lower resonant head, is designed to provide an acoustic chamber between the mesh batter head and the intermediate resonant head within the drum shell spacer, very much like an acoustic drum. This arrangement provides even more resonant tone and additional options to manipulate the acoustic signature of the drum through the DSP module.

Another alternative option to reduce the volume of the electro-acoustic drum of the present invention is to place a solid or substantially solid limiting member below the resonant drumhead in or at the bottom of the drum shell, to minimize the sound waves emerging from the drum. The limiting member can be formed of any suitable material, and any suitable thickness, to limit the vibration of the acoustic membrane of the resonant drumhead. In its most preferred application, the limiting member not only limits the sound waves emerging from the bottom of the drum shell, but also maximizes the sounds captured by the pickups within the drum shell.

Ultimately the acoustic signals from the one or more resonant heads, as well as possibly the mesh batter head, are combined to create a low volume drum sound that is then amplified and played through speakers or headphones and/or manipulated with a DSP without the drawbacks of triggered electrical systems. By using a mesh batter head one can generate a significant amount of tone and stick attack at a greatly reduced volume, approximately 30 or more dB down from an acoustic drum fitted with a solid batter head.

As is well known to one skilled in the art, higher tones are generated with heads having smaller diameters and lower tones are generated with heads having larger diameters, all of which are intended to be used with the present invention. Additionally, with the case of a snare drum, a "strainer" is preferably employed on the resonant head to replicate the snare drum sound when used with the present invention.

BRIEF DESCRIPTION OF THE DRAWINGS

The present invention will be better understood when considered in view of the attached drawings, in which like reference characters indicate like parts. The drawings, however, are presented merely to illustrate the preferred embodiment of the invention without limiting the invention in any manner whatsoever.

DETAILED DESCRIPTION OF THE PREFERRED EMBODIMENT

Figure 1:
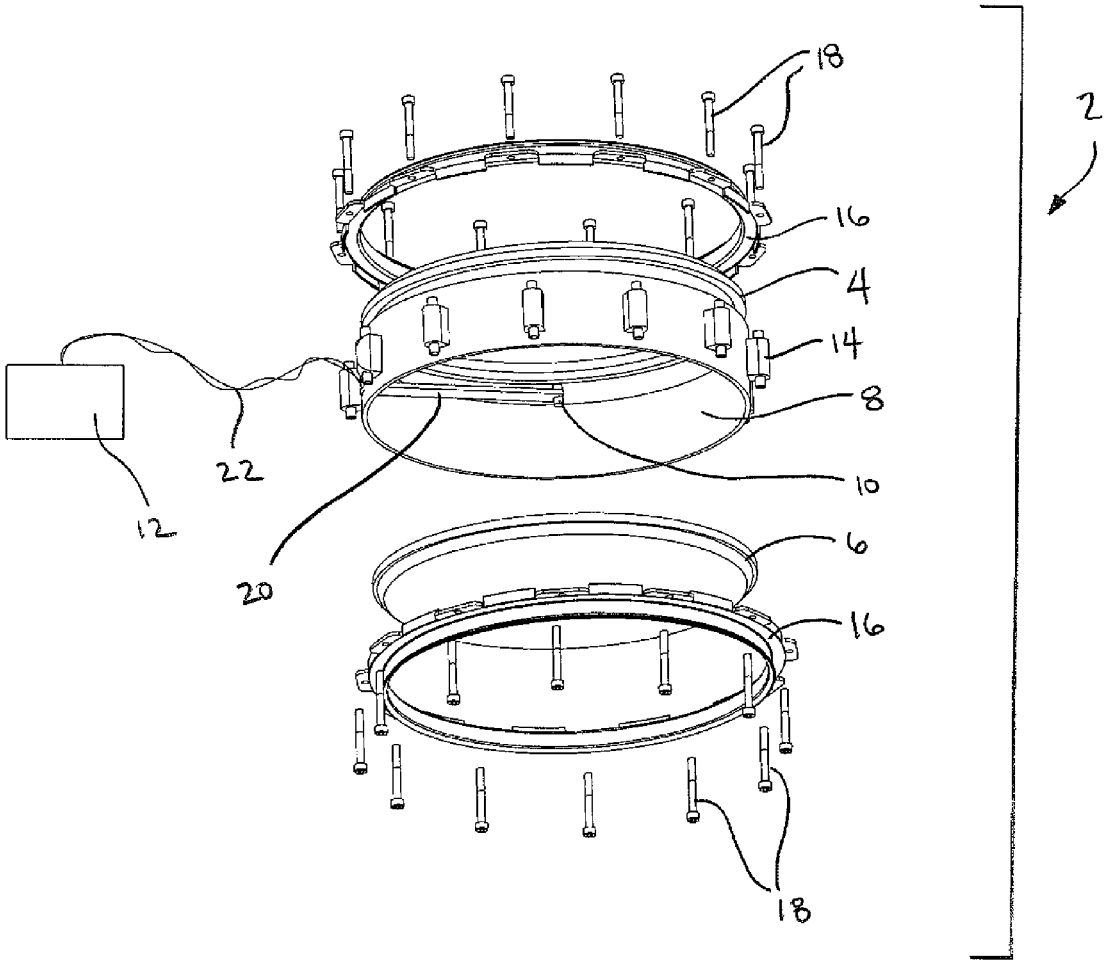
FIG. 1 is an exploded view of a preferred embodiment of the drum of the present invention.

As shown in the drawings, and particularly FIG. 1, the present invention is directed to a drum 2 comprising a mesh batter drumhead 4 formed of a mesh membrane or open material layer, a resonant drumhead 6 formed of an acoustic membrane, an annular shell member 8 and a pick-up 10 coupled to a digital signal processor (DSP) 12.

The mesh batter drumhead 4 is manufactured much the same as a standard solid or acoustic drumhead, except with a mesh membrane substituted for the solid membrane of a standard drumhead. More particularly, the peripheral edge of the mesh membrane is fixed into an annular frame or ring using a resin or the like to create the mesh batter drumhead having an annular ring.

The mesh membrane of the mesh batter drumhead 4 can be fashioned of any suitable material known for making drumheads, but having an open weave. In this regard, a synthetic polymer based material or blend of materials, and preferably a polyester or polyurethane based material, of from about 5 mil to about 14 mil thick, such as that sold by DuPont under the trademark MYLAR®, is most preferred.

The mesh membrane of the mesh batter drumhead 4 is permeable to air, preferably having about 25 to about 75% open area in the membrane, and most preferably about 30%. As set forth above, it will be understood by those skilled in the art that the amount of open area of the mesh membrane used to form the mesh batter drumhead 4 will affect the overall characteristics of the drum 2. The less open area in the mesh membrane, the more air movement created when the mesh batter head 4 is struck. All else being equal, the more air movement created by the mesh batter head 4, the more sound energy will be generated by the resonant drumhead 6, resulting in a higher volume during practice.

Although more air movement results from a mesh membrane with less open area, the effect on the acoustic membrane of the resonant drumhead 6 when the mesh batter drumhead 4 is struck is also dependent on the distance between the mesh membrane of the mesh batter drumhead 4 and the acoustic membrane of the resonant drumhead 6.

As discussed above, coupling will be improved despite the open area of the mesh membrane if the mesh membrane of the mesh batter drumhead 4 is closer to the acoustic membrane of the resonant drumhead 6. Therefore, although a mesh membrane with greater open area will produce less sound energy when struck, a closer distance between the mesh membrane and the acoustic membrane will create greater sound energy if the open area of the mesh membrane is the same.

The drum 2 of the present invention uses an annular shell member in the form of a drum shell 8 to maintain the distance between the mesh membrane of the mesh batter drumhead 4 and the solid membrane of the resonant drumhead 6. The mesh batter head 4 is mounted on the drum shell 8, which includes tensioning lugs 14 fixed about the circumference of the drum shell 8, in the same way as a standard drumhead. More particularly, a counter hoop 16 placed over the annular ring of the mesh batter drumhead 4 and corresponding tension rods 18 pass through openings on the counter hoop 30 to engage the tensioning lugs 14 on the drum shell 8. Tightening the tension rods 18 creates a downward force on the counter hoop 16, and therefore the annular frame of the mesh batter drumhead 4, to tension the mesh batter drumhead 4 over the top edge of the drum shell 8.

Based on the above assembly, the mesh batter drumhead 4 can be tensioned across the top edge of the drum shell 8 to substantially replicate the feel of a standard solid batter drumhead, but at a greatly reduced volume.

The resonant drumhead 6 used for the drum 2 of the present invention can be formed with any suitable acoustic membrane, and is generally understood to be substantially the same as a conventional drumhead. Although there are many different types of conventional drumheads that can act as the resonant drumhead 6, one formed of a synthetic polymer material from about 1 mil to about 14 mil thick, preferably 1 mil to 7 mil, and most preferably 3 mil to 5 mil, sold by DuPont under the trademark MYLAR®, is preferred. As described above with respect to the mesh batter drumhead 4, the peripheral edge of the acoustic membrane of the resonant drumhead 6 is fixed into an annular frame or ring using a resin or the like to create the resonant drumhead 6.

In the preferred embodiment of FIG. 1, the resonant drumhead 6 is tensioned across the bottom edge of the drum shell 8, opposite the mesh batter head 6, to maintain the distance between the mesh membrane and the acoustic membrane in substantially fixed relation. As with mounting the mesh batter head 4 on the top of the drum shell 8, the resonant drumhead 6 is preferably mounted on the bottom of the drum shell 8 using a counter hoop 16 and tensioning rods 18. Although independent tensioning lugs 14 can be used, the preferred embodiment shown utilizes tensioning lugs 14 adapted to receive tension rods 18 on both sides.

In the preferred embodiment shown, the height of the drum shell 8 defines the distance between the mesh membrane of the mesh batter drumhead 4 and the acoustic membrane of the resonant drumhead 6. It is generally understood that a distance of from about 0.5 to about 6 inches between the mesh and acoustic membranes may be suitable. However, when using a mesh membrane having about 25 to about 75% open area and an acoustic membrane on the resonant drumhead 6 of 1 mil to 7 mil, a distance of from about 0.5 to about 4 inches is preferred for practicing the present invention, with a distance of from about 0.5 to about 2 inches being most preferred.

In this regard, the open area and the thickness of the acoustic membrane, as well as other variables and considerations understood by those skilled in the art, can be used to determine the preferred height of the drum shell 8 according to this embodiment.

As shown in FIG. 1, the pick-up 10 is preferably placed in the drum shell 8, between the mesh batter head 4 and the resonant head 6. One or, preferably, more microphones can be used for the pick-up and may be any suitable type of microphone that is suitable for picking-up the analog sound waves generated by the resonant drumhead 6 and/or the mesh batter drumhead 4. The preferred pick-up 10 includes one or more microphones with polar patterns varying from Omni-directional to hyper-cardioid and microphone designs ranging from dynamic to electret, etc. When two microphones are employed as the pick-up 10, they may be wired either in phase or out of phase. In either case the elimination of acoustic signal cancellation and maximum signal pick-up from the respective mesh batter head 4 and resonant head 6 is the goal.

In the preferred embodiment shown, a support 20 in the form of a beam or similar structure extending from the inside wall of the drum shell 8 is used to mount the pick-up 10 between the mesh batter head 4 and the solid resonant head 6. The pick-up 10 is placed below the mesh batter head 4 should be spaced at least ⅜ of an inch from the underside surface of the mesh membrane so that it is not hit when the mesh batter head 4 is struck with a drumstick. In the preferred embodiment shown, the pick-up 10 is placed substantially on the center axis of the drum 2, substantially in the center of the drumhead circumference.

The pick-up 10 preferably converts the analog sound waves to electrical signals that can be passed to cooperative electronic components, preferably using electrical leads 22. For example, the electrical signals can be amplified and used to power headphones or speakers or fed to a digital signal processor (DSP) 12 for processing prior to amplification. Using the DSP 12, any number of signal modifications may take place. Of the many possible modifications, the DSP 12 can permit adjustments to equalization, reverb and any other sound or tonal characteristics to create and enhance the acoustic signature generated by the resonant drumhead 6 and/or the mesh batter drumhead 4.

The present invention can be adapted to virtually any size drum, with modifications to the size of the mesh batter drumhead 4, drum shell 8 and resonant drumhead 6. For example, an 18 inch diameter drum shell 8 could have an 18 inch mesh batter drumhead 4 and an 18 inch resonant drumhead 6 to create the drum 2 of the present invention. The drum 2 of the present invention adapted for use as a snare would further include a snare strainer (not shown) being held in place with strainer tension clips or the like, as known in the art.

Moreover, the above teachings can be extended to variations on and alternative embodiments of the drum 2 of the present invention. One such embodiment is shown in FIG. 2, which includes the use of an annular shell member in the form of a drum shell spacer 24 on the drum shell 8.

Figure 2:
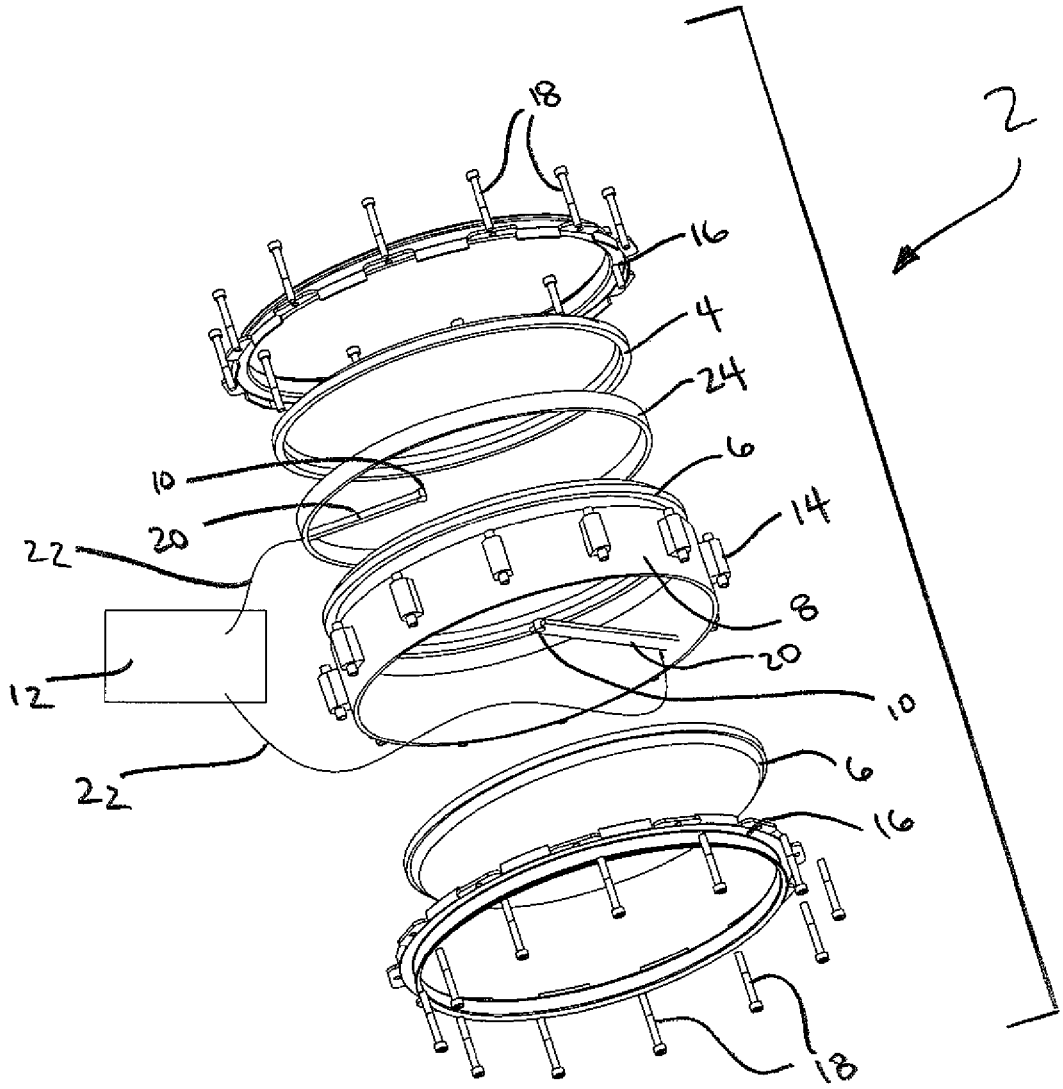
FIG. 2 is an exploded view of an alternative embodiment of the drum of the present invention.

As shown in FIG. 2, the drum shell spacer 24 is used in connection with an intermediate resonant drumhead 6' placed over the top of the original drum shell 8. Most preferably, the drum shell spacer 24 has an inner diameter that is only slightly larger than the outer diameter of the drum shell 8, so that the acoustic membrane of the intermediate resonant drumhead 6' fits therebetween. When placed over the original drum shell 8 with the intermediate resonant drumhead 6' there over, the drum shell spacer 24 defines the distance between the mesh membrane of the mesh batter head 4 and the acoustic membrane of the intermediate resonant drumhead 6' residing within the drum shell spacer 24.

The drum shell spacer 24 is preferably fitted with a pick-up 10 on a support 20 extending from the drum shell spacer 24. With respect to this pick-up 10, the same parameters set out as significant to the use of the pick-up 10 within the drum shell 8 apply. For example, the pick-up 10 on the support 20 associated with the drum shell spacer 24 should be spaced at least ⅜ of an inch from the underside surface of the mesh batter head 4, and is preferably located in the center of the drumhead circumference.

In the preferred embodiment of FIG. 2, the drum shell spacer 24 acts as the annular shell of the present invention. Preferably, the intermediate resonant drumhead 6' is placed between the drum shell spacer 24 and the top of the original drum shell 8, intermediate the batter drumhead 4 and the resonant drumhead 6 on the bottom of the drum shell 8. In this embodiment, it is preferred that the pick-up 10 between the mesh batter head 4 and the intermediate resonant drumhead 6' be used in addition to a pick-up 10 between the intermediate resonant drumhead 6' and the resonant drumhead 6. In this preferred embodiment, each of the pick-ups 10 would be associated with electrical leads 22, for transmission of the signal to be amplified for headphones or to power speakers, or fed to one or more digital signal processors (DSP) 12 for processing.

Of course, when using two resonant heads 6 and 6', each of the mesh batter head 4 and resonant heads 6 and 6' should be similarly tuned to maximize coupling. In this regard, the intermediate resonant drumhead 6' is acted upon in response to the vibrations of the batter head 4, while the lower resonant head 6 is acted upon by the vibrations of the intermediate resonant drumhead 6'.

As shown in FIG. 2, this is preferably achieved with the drum shell spacer 24 having an inner diameter only slightly larger than the drum shell 8 to allow the acoustic membrane of the intermediate resonant drumhead 6' to reside between. This configuration permits the intermediate resonant drumhead 6' to be placed across the top edge of the drum shell 8 with bottom edge of the drum shell spacer 24 resting on the annular ring of the intermediate resonant drumhead 6'. Using this configuration, the bottom edge of the drum shell spacer 24 engages the intermediate resonant drumhead 6' to maintain the batter drumhead 4 in fixed relation to the intermediate resonant drumhead 6', albeit with the acoustic membrane located within the drum shell spacer 24.

For tensioning the intermediate resonant drumhead 6' it is preferred to use longer tension rods 18 to accommodate for the extra height of the drum shell spacer 24. Thus, tightening the tension rods 18 passing through the counter hoop 16 placed over the annular ring of the mesh batter head 4 tensions both the mesh batter head 4, via the counter hoop 16, and the intermediate resonant drumhead 6', via the drum shell spacer 24, to the same degree. The ability to tension both the mesh batter head 4 and the intermediate resonant drumhead 6' at the same time simplifies coupling the tone of the respective drumheads 4 and 6'.

The acoustic/electronic drums of the present invention can be mounted on conventional drum stands, so that the drummer can retain the feel and experience of playing conventional drums. Moreover, the present drums can be used not only for practice, at reduced volumes and/or through headphones, but also in performance environments through speakers.

Variations, modifications and alterations to the preferred embodiment of the present invention described above will make themselves apparent to those skilled in the art. All such changes are intended to fall within the spirit and scope of the present invention, limited solely by the appended claims.

Any and all patents and/or patent applications referred to herein are hereby incorporated by reference.

I claim:

1. An acoustic/electronic drum assembly comprising:

a. a mesh batter drumhead comprising a mesh membrane and an annular ring;

b. a resonant drumhead comprising an acoustic membrane and an annular ring, the acoustic membrane being capable of creating analog sound waves in sympathetic response to air movement generated by a striking force applied to the mesh batter drumhead;

c. an annular shell member that engages both the mesh batter drumhead and the resonant drumhead, for maintaining the batter drumhead in fixed relation to the resonant drumhead;

d. a pick-up acoustically coupled to at least the resonant drumhead for receiving analog sound waves and creating an electrical signal.

2. The acoustic/electronic drum assembly of claim 1 wherein and the mesh batter drumhead is tensioned across a top edge of the annular shell.

3. The acoustic/electronic drum assembly of claim 2 further comprising tensioning lugs, a counter hoop and tension rods for tensioning the batter drumhead across the top edge of the annular shell.

4. The acoustic/electronic drum assembly of claim 1 wherein the resonant drumhead is tensioned across a bottom edge of the annular shell.

5. The acoustic/electronic drum assembly of claim 4 further comprising tensioning lugs, a counter hoop and tension rods for tensioning the resonant drumhead across the bottom edge of the annular shell.

6. The acoustic/electronic drum assembly of claim 3 wherein the resonant drumhead is tensioned across a bottom edge of the annular shell and the tensioning lugs for tensioning the batter drumhead across the top edge of the annular shell are also used for tensioning the resonant drumhead across the bottom edge of the annular shell.

7. The acoustic/electronic drum assembly of claim 1 further comprising one or more electrical connections to transfer the electrical signal from the pick-up within the annular shell to a signal processing device outside of the annular shell.

8. The acoustic/electronic drum assembly of claim 7 wherein the signal processing device is taken from the group consisting of headphones, an amplifier and a digital signal processor for processing the electrical signal.

9. The acoustic/electronic drum assembly of claim 1 wherein the mesh membrane comprises a synthetic polymer based material.

10. The acoustic/electronic drum assembly of claim 1 wherein the mesh membrane has an open area of from about 25 to about 75%.

11. The acoustic/electronic drum assembly of claim 10 wherein the mesh membrane has an open area of about 30%.

12. The acoustic/electronic drum assembly of claim 1 wherein the pick-up comprises one or more microphones.

13. The acoustic/electronic drum assembly of claim 12 wherein the one or more microphones are taken from the group comprising omni-directional microphones, hyper-cardioid microphones, dynamic microphones, electret microphones and combinations of these.

14. The acoustic/electronic drum assembly of claim 1 wherein the annular shell comprises an annular shell spacer associated with an original annular shell, the original annular shell having a top edge and a bottom edge and the annular shell spacer having an inner diameter only slightly larger than the outer diameter of the original annular shell.

15. The acoustic/electronic drum assembly of claim 14 wherein the batter drumhead is tensioned on the top of the drum shell spacer.

16. The acoustic/electronic drum assembly of claim 14 wherein the resonant drumhead is tensioned within the annular shell spacer over the top edge of the original annular shell.

17. The acoustic/electronic drum assembly of claim 14 wherein a second resonant drumhead is tensioned over the bottom edge of the original annular shell, further comprising a second pick-up positioned within the original drum shell between the resonant drumhead and the second resonant drumhead.

18. The acoustic/electronic drum assembly of claim 17 further comprising one or more electrical connections to transfer the electrical signal from the pick-up within the annular shell spacer and the pick-up within the original annular shell to one or more signal processing devices outside of the annular shell spacer.

19. The acoustic/electronic drum assembly of claim 18 wherein at least one of the one or more electronic devices is taken from the group consisting of headphones, an amplifier and a digital signal processor for processing the electrical signal.

20. The acoustic/electronic drum assembly of claim 17 wherein the second pick-up comprises one or more microphones.

21. A method of processing analog sound waves created by a force applied to a drumhead, wherein the drumhead is a mesh batter drumhead maintained in fixed relation to a resonant drumhead, comprising the steps of:

a. receiving analog sound waves generated at least in part by the resonant drumhead in sympathetic response to air movement generated by a force applied to the mesh batter drumhead through a pick-up acoustically coupled to the resonant drumhead;

b. converting the analog sound waves to electrical signals;

c. transmitting the electrical signals to a digital signal processor; and d. processing the electronic signals to create digital electrical signals.

22. The method of claim 21 further comprising providing user adjustment of the digital electronic signals within the digital signal processor.

23. The method of claim 21 further comprising amplifying the digital electrical signals.

* * * * *